US005373431A

United States Patent [19]

Hayman et al.

[11] Patent Number: 5,373,431

[45] Date of Patent: Dec. 13, 1994

[54] RING/BAFFLE ELEMENT FOR A TRIM OF A RECESSED LIGHTING FIXTURE

[75] Inventors: Peter A. Hayman, Arlington Heights; Giacinto C. D'Ercoli, Rolling Meadows, both of Ill.

[73] Assignee: Cooper Industries, Inc., Houston, Tex.

[21] Appl. No.: 114,078

[22] Filed: Aug. 31, 1993

[51] Int. Cl.[5] ..... F21S 1/02; F21V 11/00

[52] U.S. Cl. ..... 362/364; 362/148; 362/290; 362/345; 362/365

[58] Field of Search ..... 362/364, 290, 147, 148, 362/345, 365, 373, 342

[56] References Cited

U.S. PATENT DOCUMENTS

| | | | |
|---|---|---|---|
| 2,121,430 | 6/1938 | Guth . | |
| 2,142,395 | 1/1939 | Herron . | |
| 2,179,161 | 11/1939 | Rambusch et al. . | |
| 2,426,093 | 8/1947 | Hardman . | |
| 2,799,773 | 7/1957 | Schwartz | 362/345 |
| 3,159,351 | 12/1964 | Dwyer et al. . | |
| 3,701,895 | 10/1972 | Sweetser . | |
| 4,754,377 | 6/1988 | Wenman | 362/148 |
| 4,763,231 | 8/1988 | Houplain | 362/148 |
| 4,882,662 | 11/1989 | Prodell . | |
| 5,122,944 | 6/1992 | Webb | 362/364 |
| 5,264,994 | 11/1993 | Choi | 362/148 |

FOREIGN PATENT DOCUMENTS

| | | | |
|---|---|---|---|
| 276946 | 7/1925 | Germany | 362/342 |
| 172404 | 11/1957 | Sweden | 362/365 |
| 687792 | 2/1953 | United Kingdom | 362/365 |

OTHER PUBLICATIONS

Garcy Catalogue #39, Nov. 22, 1939 p. 19.

*Primary Examiner*—Richard R. Cole
*Assistant Examiner*—Sara Sachie Raab
*Attorney, Agent, or Firm*—Burns, Doane, Swecker & Mathis

[57] ABSTRACT

A ring/baffle element for a trim of a recessed lighting fixture comprises ring and baffle portions formed of one piece. The ring portion includes a flat trim ring. The baffle portion includes an upstanding flange, a sleeve, and a connector wall. The flange forms a socket to receive the lower end of a reflector. The sleeve is situated within a space formed by an inner periphery of the trim ring. The connector wall connects the sleeve to the ring portion. The sleeve has an inner surface forming a central main light passage. The baffle portion includes a plurality of secondary light passages spaced around a vertical axis defined by the sleeve for emitting a secondary light pattern around the outer perimeter of the main light passage. The secondary light passages can be formed in the connector wall or the sleeve.

23 Claims, 5 Drawing Sheets

Fig. 1
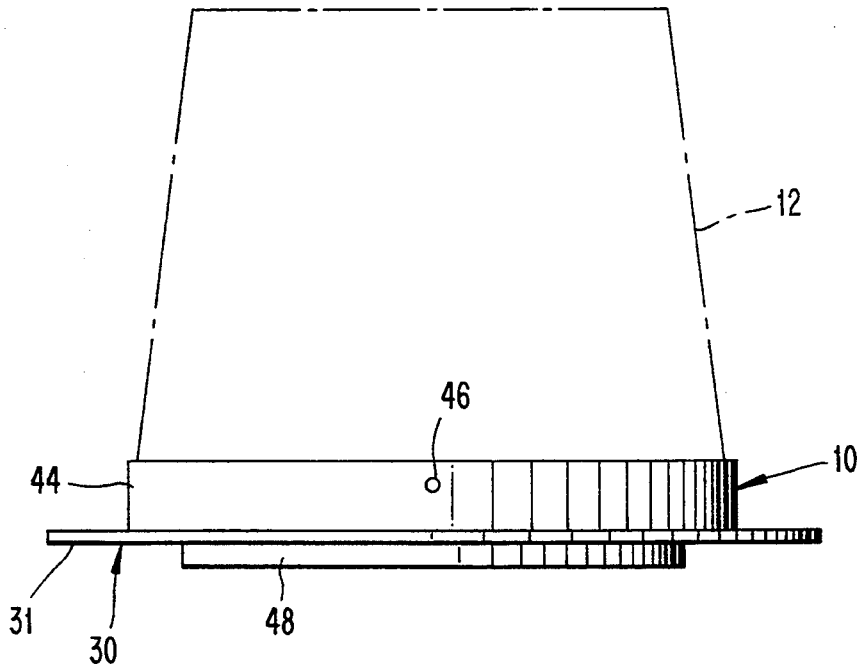
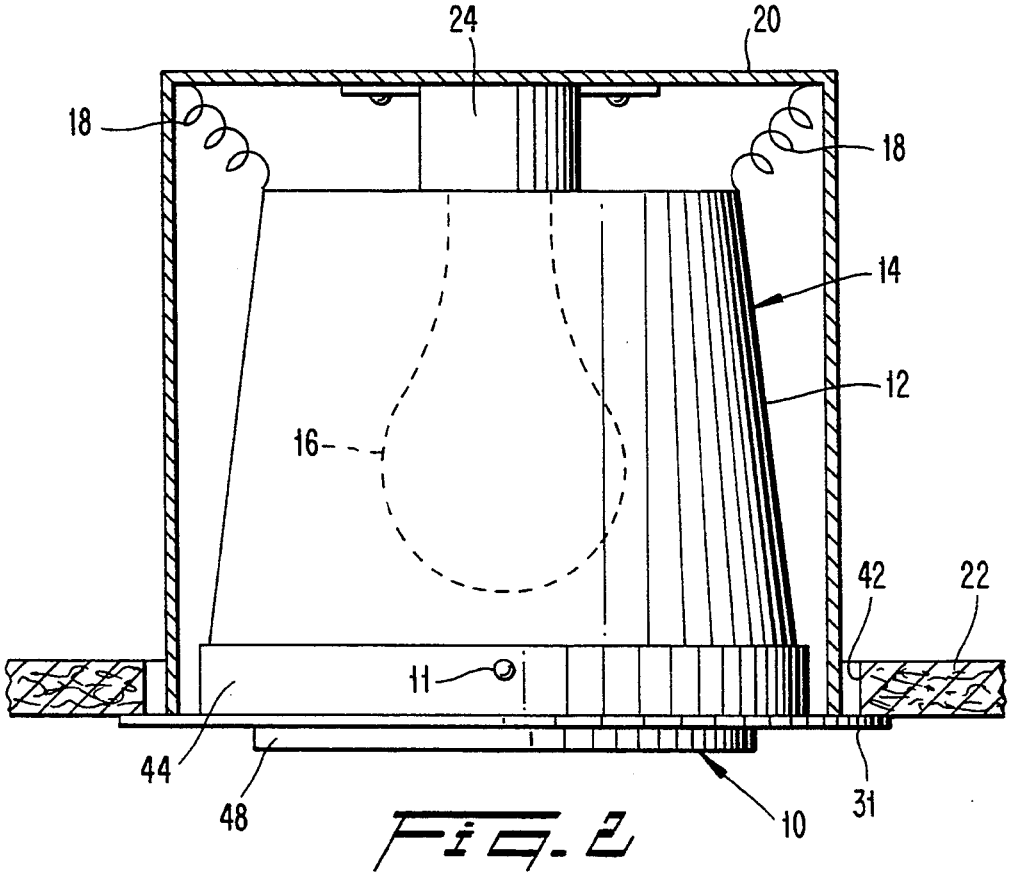
Fig. 2

RING/BAFFLE ELEMENT FOR A TRIM OF A RECESSED LIGHTING FIXTURE

BACKGROUND OF THE INVENTION

The present invention relates to recessed lighting fixtures and, in particular, to a ring/baffle element mounted on a trim portion of the fixture.

Recessed lighting fixtures mounted in ceiling structures typically comprise a housing that is secured to wooden joists or suspended members, and a trim that engages the housing and finishes out the rough opening in the ceiling tile or plastic board through which the light passes.

A typical trim comprises a ring which lays against the ceiling surface, and a separate reflector, lens, and/or baffle element that surrounds the lamp disposed within the housing. The trim is held to the housing by means of springs or screws.

A baffle element typically includes a cylindrical inner surface which defines a vertical light passage.

It would be desirable to simplify the construction and assembly of the trim, and to enhance the lighting effect which is produced.

SUMMARY OF THE INVENTION

The present invention relates to a ring/baffle element for a trim of a recessed lighting fixture. The element comprises a ring portion and a baffle portion. The ring portion includes a substantially flat trim ring having inner and outer peripheries. The baffle portion includes a flange extending upwardly from the plate adjacent the inner periphery thereof. The flange is arranged to make connection with a lower end of a reflector. The baffle portion also includes a sleeve and a connector wall. The sleeve is disposed within a space defined by the inner periphery of the trim ring and is spaced inwardly therefrom. The sleeve is coaxial with the trim ring and includes inner and outer surfaces. The inner surface defines a central main light passage. The connector wall extends from the sleeve to the ring portion for joining the baffle portion to the ring portion. The baffle portion includes secondary light passages spaced apart about a central vertical axis defined by the sleeve for emitting a secondary light pattern around an outer perimeter of the main light passage.

Preferably, the ring and baffle portions are of one piece construction and formed of a plastics material.

BRIEF DESCRIPTION OF THE DRAWINGS

The objects and advantages of the invention will become apparent from the following detailed description of preferred embodiments thereof in connection with the accompanying drawing in which like numerals designate like elements and in which:

FIG. 1 is a side elevational view of a ring/baffle element according to the present invention attached to a reflector shown in phantom lines;

FIG. 2 is a side elevational view depicting a trim comprised of the reflector and ring/baffle element of FIG. 1 mounted in a recessed housing;

DETAILED DESCRIPTION OF PREFERRED EMBODIMENTS OF THE INVENTION

Figure 3:
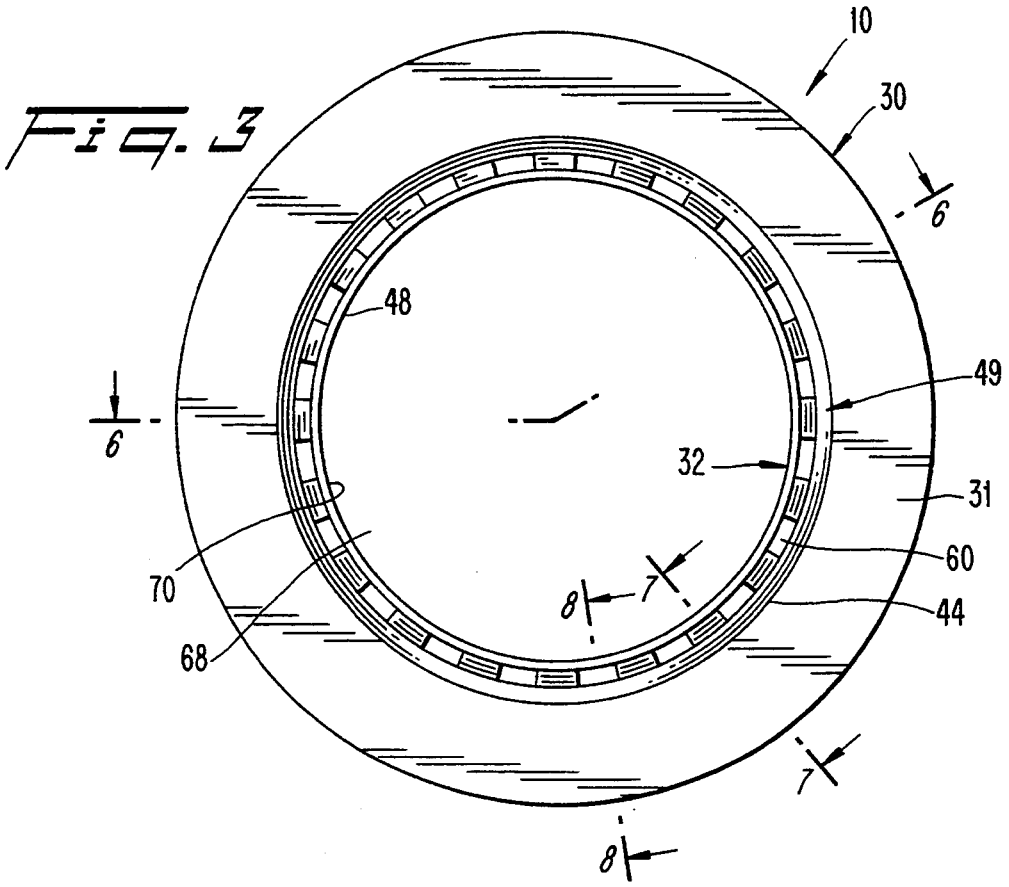
FIG. 3 is a bottom plan view of the baffle element of FIG. 1.
Figure 4:
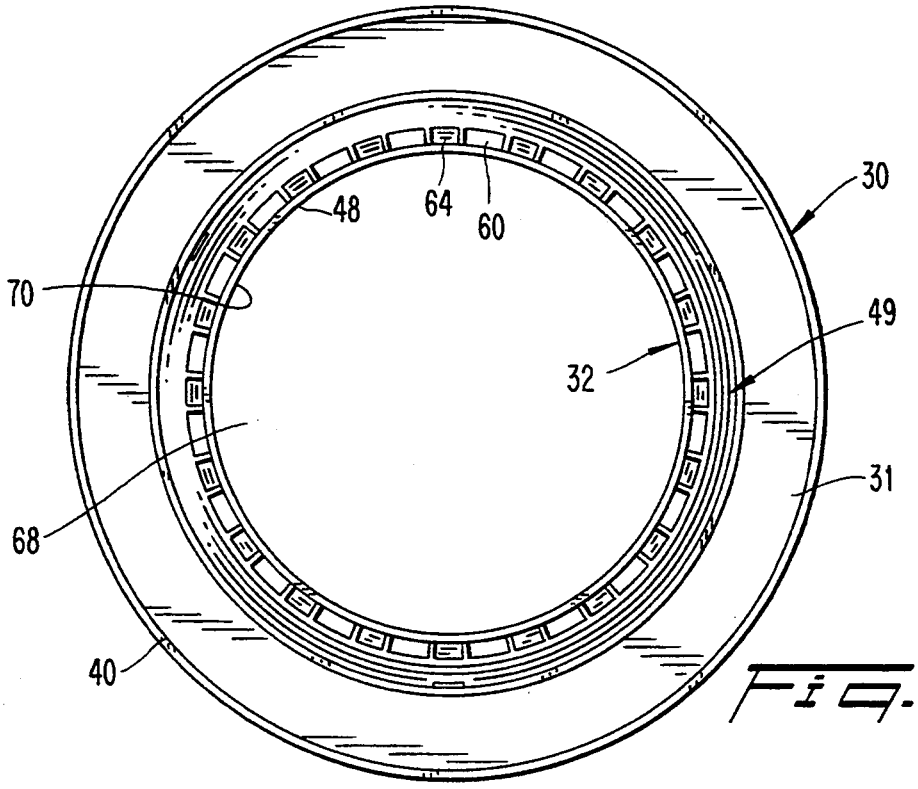
FIG. 4 is a top plan view of the baffle element of FIG. 1.
Figure 5:
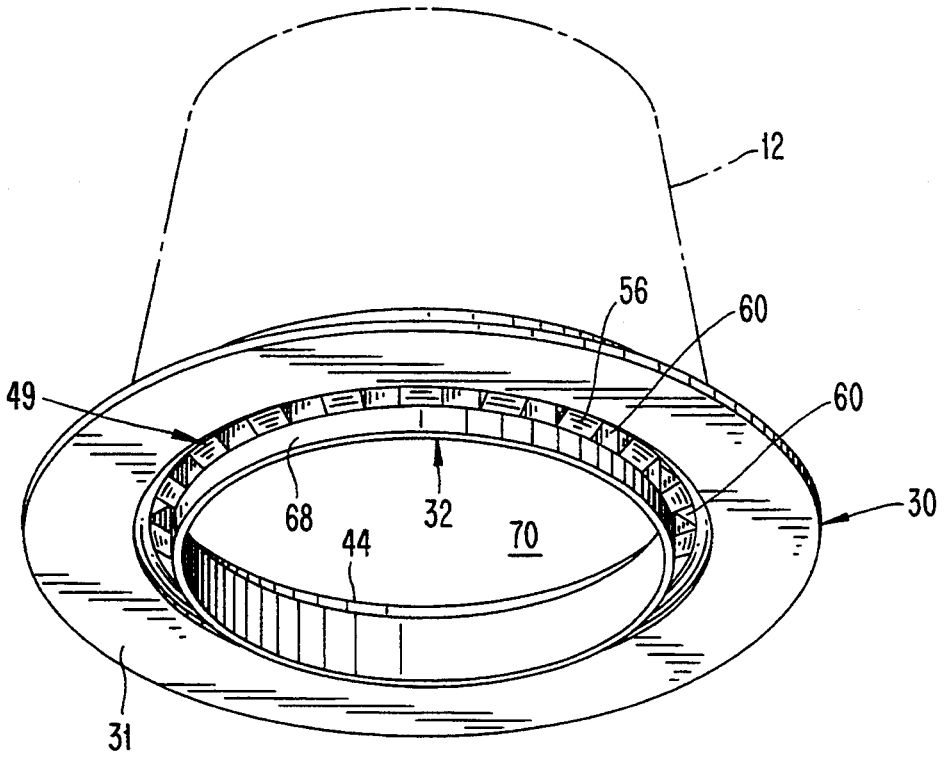
FIG. 5 is a bottom perspective view of the baffle element of FIG. 1.
Figure 6:
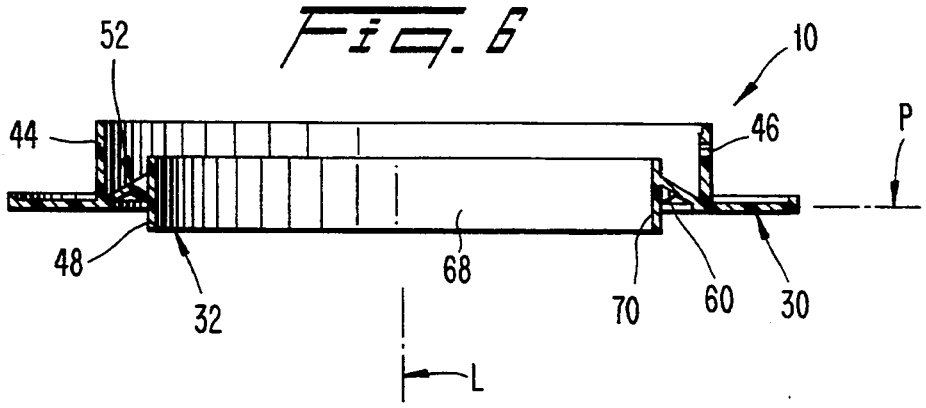
FIG. 6 is a sectional view taken along the line 6—6 of FIG. 3.

Depicted in FIG. 1 is a one-piece ring/baffle element 10 according to the present invention. FIG. 2 depicts the ring/baffle element 10 mounted by rivets 11 to a metal reflector 12 to form a trim 14 in which a lamp 16 is disposed. The trim 14 is secured by springs 18 to a cylindrical housing 20 that is secured above a ceiling 22 in the usual fashion. The lamp 16 is removably threaded within a socket 24 that is fixed to the housing 20 in any suitable manner.

The reflector 12 functions to reflect light downwardly toward the ring/baffle element 10 and to shield the housing 20 from an observer looking up toward the ceiling.

The ring/baffle element 10 includes a ring portion 30 and a baffle portion 32. The ring and baffle portions 30, 32 are preferably of one-piece construction and formed of a suitable plastics material.

The ring portion 30 forms a vertical center axis L and includes a flat horizontal annular trim ring 31 having an upwardly projecting lip 40 along its outer periphery. The overall diameter of the ring portion is larger than that of the hole 42 formed in the ceiling 22.

The baffle portion 32 includes a cylindrical flange 44 situated at an inner end of the trim ring 31. The cylindrical flange 44 has a longitudinal center axis which coincides with the axis L. The flange 44 projects upwardly from the plane P of the trim ring 31 and defines a cylindrical socket for receiving and holding the lower edge of the reflector 12. Fasteners such as rivets 11 may be inserted through a hole 46 formed in the flange 44 and a hole (not shown) formed in the reflector.

The baffle portion 32 also includes a circular cylindrical sleeve 48 and a connector wall 49. The sleeve 48 is arranged coaxially relative to the flange 44. The sleeve 48 projects both upwardly and downwardly from the plane P of the trim ring 31. An upper end of the sleeve 48 is situated below an upper end of the flange 46. The connector wall 49 retains the sleeve 48 in radially inwardly spaced relationship relative to the flange 44 such that a radial gap 50 is formed therebetween.

Figure 7:
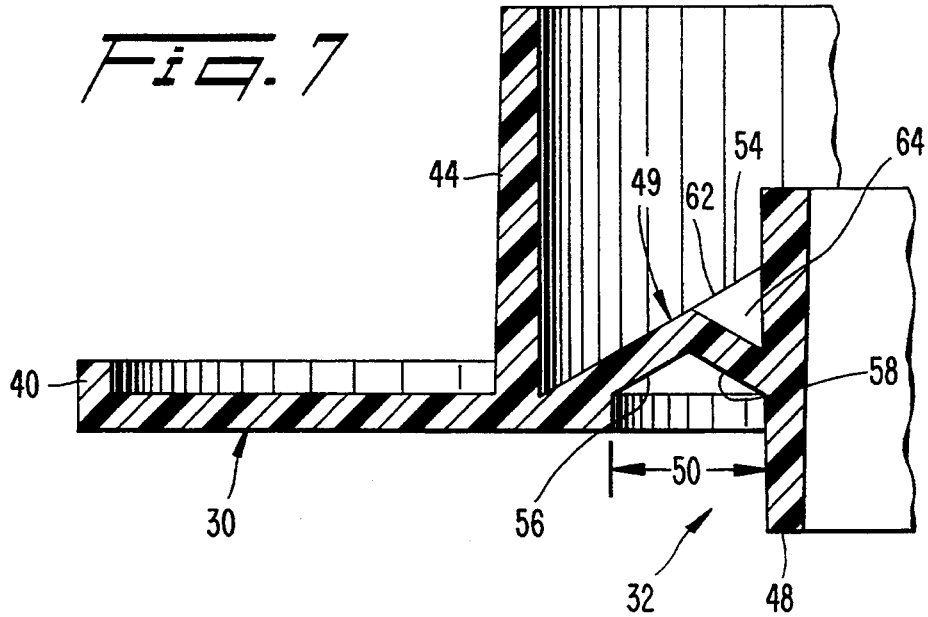
FIG. 7 is a sectional view taken along the line 7—7 of FIG. 3.

The connector wall 49 extends generally radially between the ring portion and the sleeve 48. At its junction with the sleeve 48 the inner portion of the wall 49 is of enlarged cross section, as shown in FIG. 7. Thus, the wall 49 includes an upper surface 54 which extends inclinedly upwardly from the ring portion 30 to the sleeve 48, and a lower surface which includes an outer section 56 extending parallel to the upper surface 54 to a location midway across the gap 50, and an inner section 58 extending inclinedly downwardly to the sleeve 48. Thus, the lower surface 56,58 forms a V-shape, with the angle formed by the V-shape being opened downwardly.

Formed through the wall 49 is a plurality of circumferentially spaced secondary passages 60 extending around the vertical axis L of the sleeve 48. Each secondary passage 60 extends from the upper surface 54 to the lower section 58 of the lower surface. Thus, the outer portion of the wall 49 is continuous in the circumferential direction, and the inner portion of that wall comprises circumferentially spaced connecting elements 62 arranged in alternating fashion with the secondary passages 60. The upper surface 54 is recessed in the areas of the connecting elements to define upwardly open pockets 64. Alternatively, the pockets could be eliminated.

Figure 8:
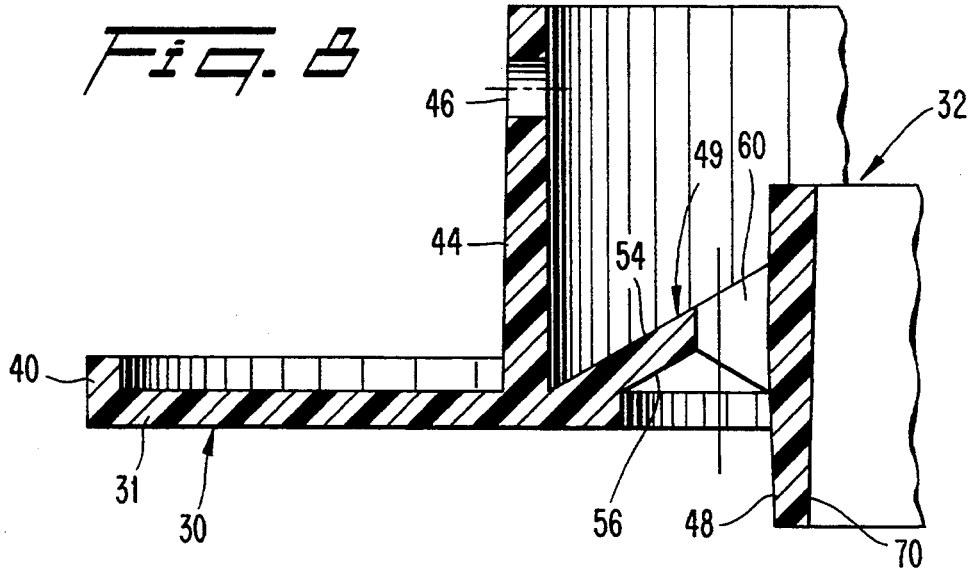
FIG. 8 is a sectional view taken along the line 8—8 of FIG. 3.

When the lamp 16 is illuminated, the light travels toward the ring/baffle element 10 either directly or upon reflection by the reflector 12. Most of the light passes through a circular main center passage 68 defined by an inner surface 70 of the sleeve 48. Some of the light, however, passes through the secondary passages 60, as depicted by an arrow in FIG. 8, to define a secondary light pattern which creates a secondary accent lighting effect around the outer perimeter of the main light passage 68. In addition, the secondary passages 60 may aid in establishing an air circulation inside of the reflector in order to enable the fixture to operate at a cooler temperature.

It will be appreciated that the secondary passages 60 which establish the secondary light pattern need not be located exactly as depicted in FIGS. 2–8. Instead, those secondary passages could be disposed, for example, in the outer portion of the wall 49, or, as shown in FIGS. 9–11, in the sleeve.

Figure 9:
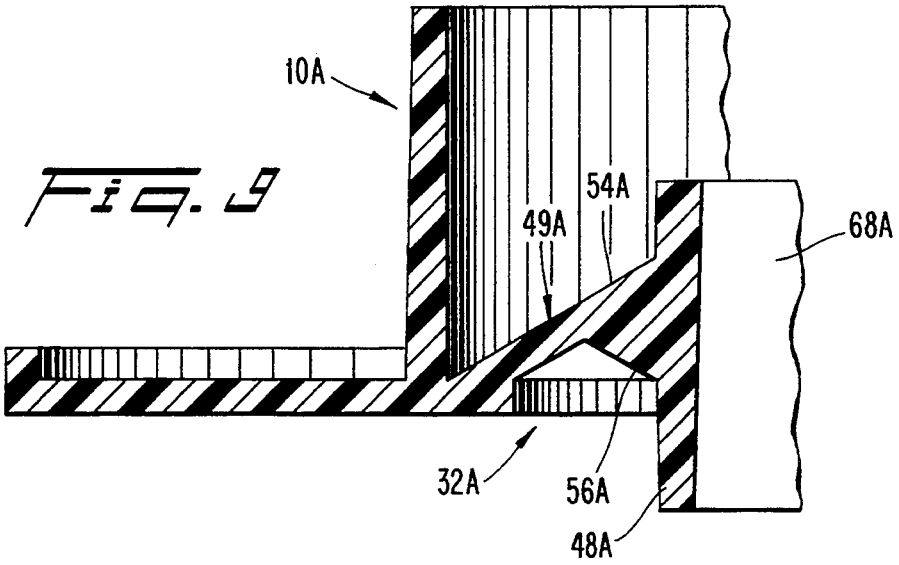
FIG. 9 is a view similar to FIG. 7 of an alternative embodiment of the present invention.
Figure 10:
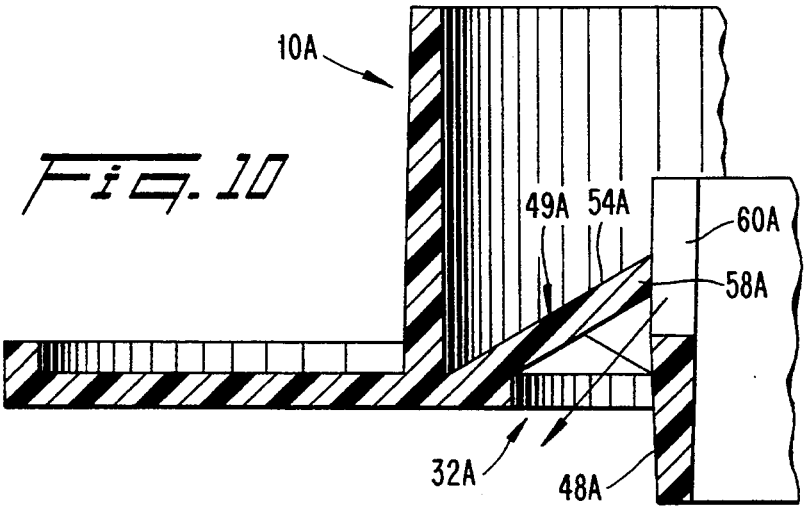
FIG. 10 is a view similar to FIG. 8 of the alternative embodiment of FIG. 9.
Figure 11:
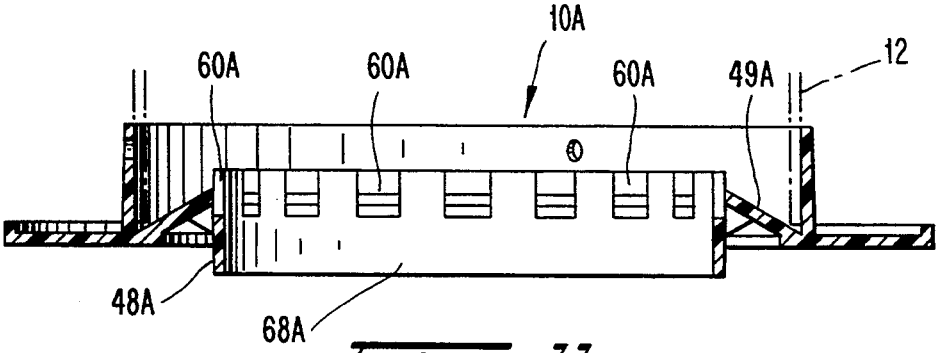
FIG. 11 is a view similar to FIG. 6 of the alternative embodiment according to FIG. 9.

Depicted in FIGS. 9–11 is a ring/baffle element 10A having secondary passages in the form of upwardly open slots 60A formed along the upper edge of the sleeve 48A of the baffle portion 32A. The connector wall 49A includes an upper surface 54A which extends continuously circumferentially around the sleeve 48A. The inner portion of the wall 49A includes alternating thick and thin sections 56A, 58A, respectively. The lower portions of the slots 60A extend below the thin sections 58A, as shown in FIG. 10, and are aligned with the thin portions. Therefore, secondary light can pass through the slots 60A and the wall 49A as depicted by an arrow in FIG. 10, to establish a secondary light pattern around the outer periphery of the main light passage 68A.

It will be appreciated that the present invention simplifies the manufacture and assembly of a fixture, since the ring and baffle portions are of one-piece construction. The ring/baffle element can be conveniently molded of plastic and attached by rivets to the reflector. The secondary passages form a secondary light pattern around the outer perimeter of the main light passage to enhance or accentuate the illumination effect.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A ring/baffle element in combination with a reflector of a recessed lighting fixture, said ring/baffle element being connected to said reflector and comprising:

a ring portion including a substantially flat trim ring having inner and outer peripheries; and a baffle portion including:

flange means extending upwardly from said trim ring adjacent said inner periphery thereof, said reflector extending downwardly toward said flange means to at least an upper end thereof, said flange means vertically overlapping a lower portion of said reflector, said lower portion of said reflector being situated inside of said flange means, a sleeve disposed within a space defined by said inner periphery of said trim ring and spaced inwardly from said trim ring, said sleeve being coaxial with said trim ring and including inner and outer surfaces, said inner surface defining a central main light passage, and a connector wall extending from said sleeve to said ring portion for joining said baffle portion to said ring portion, said baffle portion including secondary light passages spaced apart about a central vertical axis defined by said sleeve for emitting a secondary light pattern around an outer perimeter of said main light passage.

2. A ring/baffle element and reflector according to claim 1, wherein said ring and baffle portions are of one piece construction.

3. A ring/baffle element and reflector according to claim 2, wherein said one-piece ring and baffle portions are formed of plastic.

4. A ring/baffle element and reflector according to claim 1, wherein said trim ring is of annular shape, and said flange means and sleeve are of circular cylindrical shape.

5. A ring/baffle element and reflector according to claim 1, wherein said sleeve extends above and below a plane defined by said trim ring.

6. A ring/baffle element and reflector according to claim 5, wherein said flange means extends only above said plane.

7. A ring/baffle element and reflector according to claim 6, wherein an upper end of said sleeve is situated below an upper end of said flange means.

8. A ring/baffle element and reflector according to claim 1, wherein said secondary passages are formed in said connector wall.

9. A ring/baffle element and reflector according to claim 1, wherein said secondary passages are formed in said sleeve.

10. A ring/baffle element and reflector according to claim 1, wherein a portion of said reflector disposed above said flange means is of frusto-conical shape.

11. A ring/baffle element according to claim 10, wherein said secondary passages comprise upwardly open slots formed in an upper edge of said sleeve, at least lower portions of said slots being situated below a place where said connector wall joins said sleeve.

12. A ring/baffle element and reflector according to claim 1, wherein said reflector is connected to said ring/baffle element by fasteners extending through said flange means and said lower portion of said reflector.

13. A ring/baffle element and reflector according to claim 1, wherein said secondary light passages extend for only a portion of a distance from said sleeve to said ring portion.

14. A ring/baffle element and reflector according to claim 13, wherein said connector wall forms a V-shaped lower surface such that the angle formed by the V-shape opens downwardly, said secondary light passages being located closer to said sleeve than to said ring portion.

15. A ring/baffle element for a trim of a recessed lighting fixture, comprising:

a ring portion including a substantially flat trim ring having inner and outer annular peripheries; and a baffle portion formed of one piece with said ring portion and including:

a cylindrical flange extending upwardly relative to a plane defined by said trim ring adjacent said inner periphery thereof, said flange forming a cylindrical socket for receiving a lower end of a reflector of the trim, a cylindrical sleeve arranged coaxially with said trim ring and said flange and spaced radially inwardly from said inner periphery of said trim ring, said sleeve extending upwardly and downwardly past said plane of said trim ring, said sleeve including inner and outer cylindrical surfaces, said inner surface defining a central main light passage, and a connector wall formed of one piece with said sleeve, said connector wall extending from said sleeve to said ring portion for joining said baffle portion to said ring portion, said baffle portion including secondary light passages formed in said connector wall and spaced apart circumferentially with reference to a central vertical axis defined by said inner surface of said sleeve for emitting a secondary light pattern around an outer perimeter of said main light passage, said connector wall including an outer section connected to said ring portion, and an inner portion connected to said sleeve, said inner portion being thicker than said outer portion, said secondary passages being formed in said inner portion.

16. A ring/baffle element according to claim 15, wherein said one piece ring and baffle portions are formed of plastic.

17. A ring/baffle element according to claim 15, wherein an upper end of said flange is situated above an upper end of said sleeve, and a lower end of said flange is situated above a lower end of said sleeve.

18. A ring/baffle element according to claim 17, wherein said outer periphery of said trim ring has an upwardly projecting lip.

19. A ring/baffle element for a trim of a recessed lighting fixture, comprising:

a ring portion including a substantially flat trim ring having inner and outer peripheries; and a baffle portion including:

flange means extending upwardly from said trim ring adjacent said inner periphery thereof, said flange means being arranged to make connection with a lower end of a reflector, a sleeve disposed with a space defined by said inner periphery of said trim ring and spaced inwardly from said trim ring, said sleeve being coaxial with said trim ring and including inner and outer surfaces, said inner surface defining a central main light passage, and a connector wall extending from said sleeve to said ring portion for joining said baffle portion to said ring portion, said baffle portion including secondary light passages formed in said sleeve and spaced apart about a central vertical axis defined by said sleeve for emitting a secondary light pattern around an outer perimeter of said main light passage.

20. A ring/baffle element in combination with a reflector of a recessed lighting fixture, said ring/baffle element being connected to said reflector and comprising:

a ring portion including a substantially flat trim ring having inner and outer peripheries; and a baffle portion including:

flange means extending upwardly from said trim ring adjacent said inner periphery thereof, said reflector extending downwardly toward said flange means to at least an upper end thereof, said flange means vertically overlapping a lower portion of said reflector, said reflector connected to said ring/baffle element by fastener extending through said flange means and said lower portion of said reflector, a sleeve disposed within a space defined by said inner periphery of said trim ring and spaced inwardly from said trim ring, said sleeve being coaxial with said trim ring and including inner and outer surfaces, said inner surface defining a central main light passage, and a connector wall extending from said sleeve to said ring portion for joining said baffle portion to said ring portion, said baffle portion including secondary light passages spaced apart about a central vertical axis defined by said sleeve for emitting a secondary light pattern around an outer perimeter of said main light passage.

21. A ring/baffle element in combination with a reflector of a recessed lighting fixture, said ring/baffle element being connected to said reflector and comprising:

a ring portion including a substantially flat trim ring having inner and outer peripheries; and a baffle portion including:

flange means extending upwardly from said trim ring adjacent said inner periphery thereof, said reflector extending downwardly toward said flange means to at least an upper end thereof, a sleeve disposed within a space defined by said inner periphery of said trim ring and spaced inwardly from said trim ring, said sleeve being coaxial with said trim ring and including inner and outer surfaces, said inner surface defining a central main light passage, and a connector wall extending from said sleeve to said ring portion for joining said baffle portion to said ring portion, said baffle portion including secondary light passages spaced apart about a central vertical axis defined by said sleeve for emitting a secondary light pattern around an outer perimeter of said main light passage, said secondary light passages extending for only a portion of a distance from said sleeve to said ring portion.

22. A ring/baffle element and reflector according to claim 21, wherein said reflector is connected to said ring/baffle element by fasteners extending through said flange means and said lower portion of said reflector.

23. A ring/baffle element and reflector according to claim 22, wherein said lower portion of said reflector is situated inside of said flange means.

* * * * *